United States Patent [19]

Alibeckoff

[11] 4,264,545

[45] Apr. 28, 1981

[54] PROCESS FOR PRODUCING MOP YARN

[75] Inventor: Galib-Bey A. Alibeckoff, Lakewood, Ohio

[73] Assignee: Sponge, Inc., Cleveland, Ohio

[21] Appl. No.: 19,382

[22] Filed: Mar. 12, 1979

[51] Int. Cl.[3] ..... B29D 7/00

[52] U.S. Cl. ..... 264/45.8; 15/229 R; 57/210; 156/78; 156/161; 264/46.1; 264/147; 264/174; 264/243

[58] Field of Search ..... 428/304, 294, 314, 536; 57/210; 156/78, 161; 15/229 R; 264/147, 45.1, 243, 54, 174, 46.5, 45.8, 46.1

[56] References Cited

U.S. PATENT DOCUMENTS

| | | | |
|---|---|---|---|
| 1,994,396 | 3/1935 | Kilner | 264/174 |
| 2,032,941 | 3/1936 | Linscott et al. | 264/174 |
| 2,076,711 | 4/1937 | Eagleson | 264/174 |
| 2,122,335 | 6/1938 | Berman et al. | 264/174 |
| 2,408,398 | 10/1946 | Johnson | 264/174 |
| 2,409,660 | 10/1946 | Briggs | 57/153 |
| 2,600,143 | 6/1952 | Vaughn | 154/53.6 |
| 2,979,431 | 4/1961 | Perrault | 264/174 |
| 3,068,545 | 12/1962 | Stiner | 28/72 |
| 3,301,932 | 1/1967 | Chisholm | 264/174 |
| 3,321,903 | 5/1967 | Tanzer | 57/140 |

*Primary Examiner*—Jay H. Woo

*Attorney, Agent, or Firm*—Holder, Gross & Yavner

[57] ABSTRACT

A mop yarn is produced by extruding onto the embossed face of a conveyor belt a first layer of a fiber reinforced sponge forming viscose mass, feeding regularly transversely spaced core yarns onto the conveyor advanced first layer and extruding a second layer of the sponge forming viscose mass onto the core yarn carrying first layer. The composite layers are then coagulated, regenerated and purified, and the resulting cellulose sponge web is then longitudinally slit to produce sponge strands in each of which is embedded and bonded at least one of the core yarns. The resulting cellulose sponge mop yarn is of rectangular transverse cross section and has low porosity water permeable top and bottom faces at least one of which is embossed and skinless side faces and each yarn has one or more core yarns of cotton twine embedded therein and bonded to the sponge material.

9 Claims, 5 Drawing Figures

PROCESS FOR PRODUCING MOP YARN

BACKGROUND OF THE INVENTION

The present invention relates generally to improvements in floor mops and the like and their method of production and it relates more particularly to an improved water absorbent mop yarn and to an improved method of producing mop yarn.

The conventional wet floor mop is formed of twisted cotton yarns which have been bleached to increase their wettability and water absorbency. Such a mop possesses many drawbacks. The yarns have little strength and durability and hence a short life expectancy, are easily tangled with each other and individually untwisted to interfere with and limit the use of the mop, and they retain dirt and frequently sour and turn musty and otherwise leave much to be desired. In order to overcome the drawbacks of cotton mop yarn, there has been proposed and used as a mop yarn a core yarn surrounded by a sheath of regenerated cellulose sponge which is bonded to the core yarn and which has a skin surface of greater density and lower porosity than the body of the sheath. The yarns are individually produced by extruding a viscose sheath containing a pore forming material onto the individual core yarns and then regenerating the cellulose. A cellulose sponge sheathed mop yarn and its production are described in U.S. Pat. Nos. 2,409,660 issued Oct. 22, 1946, No. 2,600,143 issued June 10, 1952 and No. 3,321,903 issued May 30, 1967. In U.S. Pat. No. 3,068,545 there is described a process of treating sponge coated yarns by passing the yarns between abrasive covered rollers to abrade the skin surface and raise a fibrous nap on both sides of the yarn. While the sponge coated yarns heretofore proposed overcame many of the drawbacks of the conventional cotton mop yarn, they possess numerous disadvantages. They are expensive and difficult to produce and have somewhat low water absorption and capillary speed properties and slow wettability and have other undesirable properties.

SUMMARY OF THE INVENTION

It is a principal object of the present invention to provide an improved mop yarn and an improved method of producing mop yarns.

Another object of the present invention is to provide an improved mop yarn of the sponge sheathed core yarn type and an improved method of producing the same.

Still another object of the present invention is to provide an improved cellulosic sponge sheathed yarn having a high water absorption capacity, a high capillary speed and an instantaneous wettability.

A further object of the present invention is to provide an improved method for producing cellulosic sponge sheathed yarn, which method is simple, reliable and inexpensive.

The above and other objects of the present invention will become apparent from a reading of the following description taken in conjunction with the accompanying drawings which illustrate a preferred embodiment thereof.

The improved mop yarn in accordance with the present invention comprises a longitudinally extending strand of a porous water absorptive sponge material and having at least one water permeable relative low porosity face and at least one water permeable high porosity face and a core yarn embedded in and extending continuously longitudinally along the length of said strand.

In producing the mop yarn by the improved method, there is formed a sponge web having water permeable relatively low porosity skins on its opposite faces and having embedded therein transversely spaced, parallel longitudinally extending core yarns and longitudinally slicing the web into longitudinal strands with at least one core yarn disposed or embedded in each of the strands.

In the preferred form of the mop yarn, the sponge strand is of a hydrophyllic cellulosic material, preferably regenerated cellulose, is fiber reinforced and of rectangular transverse cross section with its top and bottom faces having low porosity, high density water permeable skins and its side faces being skin free. The width of the individual strand is between 3/32 inch and 1 inch, and its thickness is between 3/32 inch and ½ inch, and while each strand preferably contains a single core yarn, it may contain more than one core yarn, for example, up to four. The core yarn may be formed of natural or synthetic fibers or filaments, but is advantageously formed of a twisted, preferably multiple ply cellulosic fiber such as cotton or rayon and is chemically and mechanically bonded to the surrounding sponge material. Each strand may be a laminate of upper and lower layers integrally bonded at their interface and the reinforcing fibers in the respective sponge layers may be at an angle to those in the other layer, for example, the fibers in one layer may be in part transversely oriented and those in the other layer longitudinally oriented or the fibers may be randomly oriented. The tensile strength of the core yarns in each strand should preferably exceed five pounds. One or both of the strand skin faces may be embossed to increase the surface area thereof. In fabricating a mop, a bunch of the strands cut to predetermined lengths are assembled and bound or clamped in any suitable manner, such as in the case of floor mops formed with conventional mop yarns.

In the preferred method of producing the improved yarn, a layer of viscose having reinforcing fibers and particulate sodium sulfate decahydrate dispersed therein is deposited or extruded onto the top face of a longitudinally advancing endless belt having an embossed outer face, the layer being extruded with the reinforcing fibers being in part transversely oriented. A plurality of regularly transversely spaced core yarns are longitudinally, parallely guided onto the face of the advancing viscose mass layer to advance therewith, and a second sponge forming viscose mass layer is deposited on the core yarn, carrying first layer with the reinforcing fibers therein longitudinally oriented. The viscose mass layers are then coagulated and regenerated, the sodium sulfate decahydrate leached out and the resulting regenerated cellulose sponge web bleached and purified and then longitudinally slit to produce strands of the desired width, with each strand containing one or more core yarns.

The improved method of producing the mop yarns is simple and reliable, requiring a minimum of complex forming equipment and results in a uniform, inexpensive end product of superior quality. The improved mop yarn produced as above is characterized by its great strength and durability, high water absorption and capillary speed instantaneous wettability and low cost.

DESCRIPTION OF THE PREFERRED EMBODIMENTS

Figure 1:
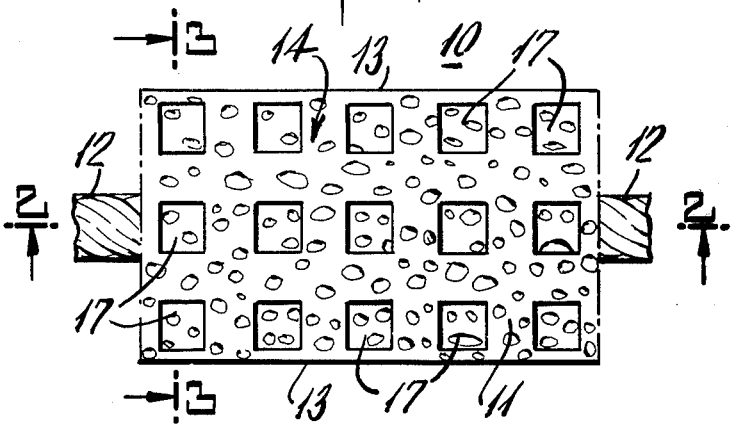
FIG. 1 is an enlarged fragmentary top plan view of a mop yarn embodying the present invention.
Figure 2:
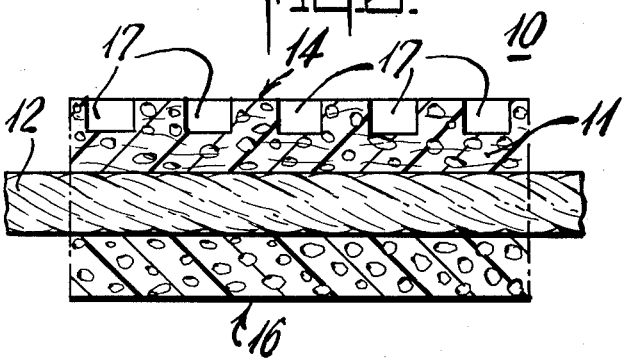
FIG. 2 is a sectional view taken along line 2—2 in FIG. 1.
Figure 3:
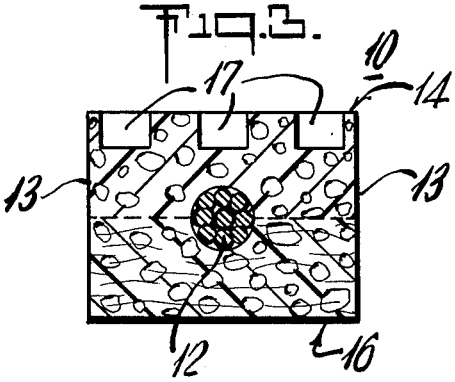
FIG. 3 is a sectional view taken along line 3—3 in FIG. 1.

Referring now to the drawings, particularly FIGS. 1 to 3 thereof, which illustrate a preferred embodiment of the present invention as it relates to the product, the reference numeral 10 generally designates the improved mop yarn which includes a sponge strand 11 and a reinforcing core yarn 12 embedded in and bonded to the sponge strand 11 and extending longitudinally for the length of the strand 11. The strand 11 is of rectangular transverse cross section having, for example a width of ¼ inch and a thickness of 3/16 inch, and includes side faces 13 and top and bottom faces 14 and 16 respectively, as viewed in FIGS. 1 and 2.

The sponge strand 11 is formed of a fine pore, hydrophyllic sponge material, specifically a viscose regenerated cellulose material and includes upper and lower layers integrally bonded to each other at their interface. The regenerated cellulose sponge material is reinforced with fibers which may be natural or synthetic but is advantageously cellulose such as cotton fibers, cellulose pulp fibers and the like. The fibers in the sponge lower layer are longitudinally oriented and those in the sponge upper layer are mostly transversely oriented or randomly oriented.

The strand side faces 13 have the same porosity as the body or matrix of sponge strand 11, and are produced by slitting or slicing a web of the sponge material, whereas the top and bottom faces 14 and 16 are defined by self-formed skins which are integral with the matrix of the strand sponge material and have a greater bulk density and smaller porosity than the body of strand 11 and side faces 13, but are highly water permeable. The strand top face 14 is embossed to increase the surface area thereof, and to provide many scouring or rubbing edges along the face. While the embossed face 14 is illustrated as being affected by regularly spaced rectangular wells 17, other embossed patterns may be employed and the bottom face 16 may be also embossed.

The core yarn 12 is a high strength multiple ply twisted preferably cellulosic yarn and is centrally disposed or embedded in the strand 11 and is chemically and mechanically bonded to the matrix of the sponge strand. Examples of core yarns which may be employed to advantage are a 6-ply cotton twine having a tensile strength of 15 pounds or an 8-ply cotton twine having a tensile strength of 20 pounds. While the mop yarn 10 is shown as being reinforced by a single core yarn, a plurality of longitudinally extending parallel core yarns may be embedded in the strand 11, for example, two to four core yarns.

Figure 4:
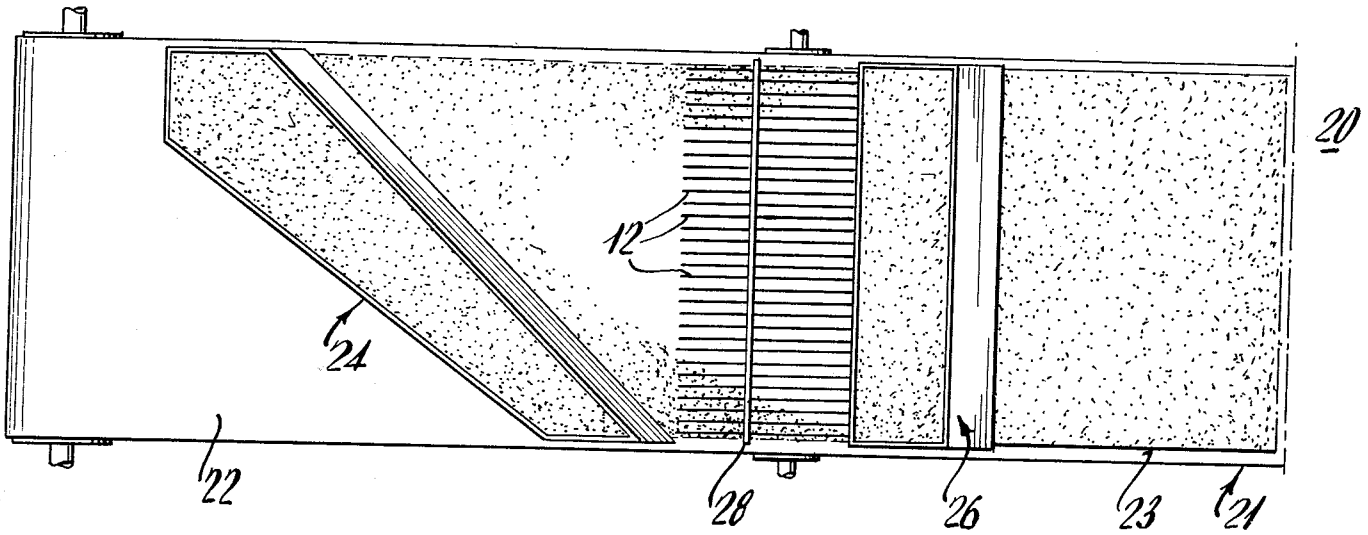
FIG. 4 is a top plan fragmentary view of an apparatus for producing the mop yarn in accordance with the improved method.
Figure 5:
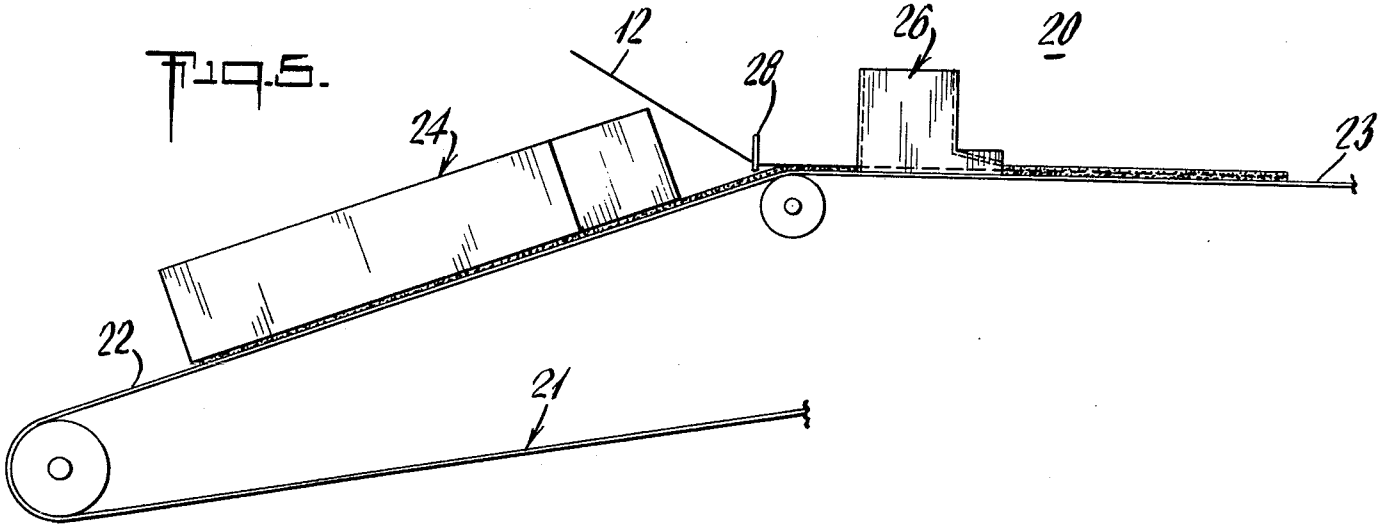
FIG. 5 is a side elevational view thereof.

In producing the mop yarn 11, in accordance with the present improved method, the apparatus 20 illustrated in FIGS. 4 and 5 of the drawings is employed. The apparatus 20 includes an endless conveyor belt 21 having an embossed outer face complementing that of strand top face 14. The belt 21 is advanced along an upwardly forwardly inclined traveling top run 22, and thence along a horizontal run 23. The belt 21 is formed of any suitable chemical resistant material, such as a fabric reinforced neoprene web, or the like.

Positioned directly above belt 21 along traveling run 22 is a first sheet or layer extrusion device 24 in the form of a hopper, open at its top and bottom, and having a bottom opening in its front wall which delineates an extrusion slot with the top face of belt 21. Positioned directly above belt 21 along run 23 shortly forwardly of run 22 is a second sheet extrusion device 26 of the hopper type, having an open bottom and a front wall extrusion opening. One or both extrusion devices 24 and 26 may be of the fiber disorientation type such as disclosed in U.S. Pat. Nos. 2,899,704 and 2,989,775 granted Aug. 18, 1959 and June 27, 1961, respectively to F. Pekarek; or one or both extrusion devices 24 and 26 may be simple open bottomed hoppers with adjustable front wall extrusion slots so that the fibers in the extruded fiber reinforced sponge forming mass are longitudinally oriented.

A multiple thread guide 28 is located shortly above and shortly rearwardly of the junction of belt runs 22 and 23, and extends transversely for the width of the belt 21 and may be a comb or any other suitable guide structure for leading a plurality of regularly transversely spaced parallel core yarns 12 onto the layer of sponge forming mass extruded by extrusion device 24 and advancing with belt 21 along run 23. A creel or beam, not shown, may be provided for supporting the spools or other packages from which core yarns 12 are drawn. Any suitable apparatus of known construction is provided following the extrusion device for liquid treating the assembled core yarn sponge forming mass sheet to coagulate and purify and otherwise treat the mass to form a sponge web having skins along its top and bottom faces and parallel core yarns embedded therein. Following the liquid treatment apparatus, a slicing device is provided for longitudinally slitting the sponge web to form strands of the desired width, each strand having one or more core yarns therein.

In accordance with the present method for producing mop yarns of regenerated cellulose sponge of the improved construction viscose is produced in the known manner and admixed with reinforcing fibers and particulate sodium sulfate decahydrate For example, dissolving cellulose pulp is steeped in sodium hydroxide to alkalize the cellulose which is then reacted with carbon bisulfide to produce cellulose xanthate which is then dissolved in a sodium hydroxide solution. The proportions of the reactants are such to form viscose containing 8.5% cellulose, 6.3% total alkalinity, 3.3% total sulfur and 2.2% xanthate sulfur. The viscose is then uniformly admixed with reinforcing fibers and particulate sodium sulfate decahydrate to form the sponge forming mass. For example, 600 pounds of the viscose is admixed with 33 pounds of reinforcing fibers consisting of cotton shoddy and cellulose pulp fibers, 1700 pounds sodium sulfate decahydrate crystals of a particle size of about 1 to 2 millimeters and other additives such as a wetting agent, dyes and the like.

The sponge forming mass is deposited in the extrusion hoppers 24 and 26, which are adjusted to extrude successive superimposed layers of the sponge forming mass of, for example, thicknesses of 3/32 inch and widths of about 45 inches. Fed onto the top face of the first or bottom sponge forming layer and led thereon by guide 28 are regularly transversely spaced core yarns 12, for example, 210 six or eight-ply twisted cotton twine of 15 to 20 pounds tensile strength, the twines being located for the full width of the sponge mass layer. A second viscose sponge mass layer is extruded by extrusion hopper 26 onto the advancing core yarn carrying bottom layer, the second layer having a thickness of 3/32 inch so that the core yarns are medially sandwiched between the sponge mass layers.

The advancing core yarn carrying web is then treated with a 20% solution of sodium sulfate at 102° C. to coagulate and partially regenerate the viscose mass and leach the sodium sulfate decahydrate and regeneration is completed by treating the mass with sulfuric acid of 10 grams per liter at 70° C. and the regenerated viscose mass is washed to purify it and leach and extract the remaining sodium sulfate. The regenerated cellulose sponge web is then bleached and plasticized and otherwise treated.

The finished web is then longitudinally sliced by advancing it along regularly transversely spaced blades or other slicing elements to produce the mop yarn defining strands of the desired widths, for example, ¼ inch, each strand having at least one of the core yarns 12 embedded therein and anchored and bonded to the sponge matrix.

The resulting mop yarns are of the construction described above, being of rectangular transverse cross section, and with high porosity side faces and low porosity high density skins at its top and bottom faces, the top face, and if desired, the bottom face being embossed. The improved mop yarn possesses greater water absorption and capillary speed than previously available cellulose sponge mop yarns and an instantaneous wettability as contrasted to the slow wettability of the earlier mop yarns, and it is much less expensive to produce.

While there have been described and illustrated preferred embodiments of the present invention, it is apparent that numerous alterations, omissions and additions may be made without departing from the spirit thereof.

I claim:

1. A method of producing a mop yarn comprising forming a longitudinally extending sheet of viscose containing a pore forming material and having embedded therein regularly transversely spaced longitudinally extending core yarns, regenerating the cellulose in said viscose to produce a hydrophylllic sponge web having water permeable, relatively low porosity top and bottom skins, and a relatively high porosity matrix and having said core yarns embedded therein and bonded thereto and thereafter longitudinally slitting said sheet along a plurality of transversely spaced parallel lines to produce sponge strands with each of said strands having at least one of said core yarns embedded therein and relatively low porosity water permeable skins along the top and bottom thereof and skin free faces along the sides thereof.

2. The method of claim 1 wherein said viscose sheet is deposited onto a longitudinally advancing conveyor belt and is coagulated while supported by said belt.

3. The method of claim 1 wherein said yarn carrying viscose sheet is produced by depositing onto a longitudinally advancing belt a first layer of said viscose containing said pore forming material, depositing on the advancing first viscose layer said transversely spaced core yarns to advance with said first layer and depositing onto said yarn carrying first layer a second layer of said viscose containing said pore forming material.

4. The method of claim 2 wherein said conveyor belt has an embossed face to correspondingly emboss the overlying face of said viscose sheet.

5. The method of claim 3 wherein said viscose layers are fiber reinforced.

6. The method of claim 1 wherein said viscose sheet has reinforcing fibers dispersed therein.

7. The method of claim 1 wherein said core yarns comprise twisted multiple ply cotton twines.

8. The method of claim 1 wherein said sponge web has a thickness between 3/32 inch and ½ inch and is longitudinally slit into strands having widths between 3/32 inch and 1 inch.

9. The method of claim 3 wherein at least one of said viscose layers has reinforcing fibers of random orientation dispersed therein.

* * * * *